United States Patent [19]

Hartley

[11] Patent Number: 5,018,622

[45] Date of Patent: May 28, 1991

[54] BATTERY DISPLAY PACKAGE

[75] Inventor: William L. Hartley, Annapolis, Md.

[73] Assignee: P.T.P. Industries, Baltimore, Md.

[21] Appl. No.: 544,402

[22] Filed: Jun. 27, 1990

[51] Int. Cl.[5] ..... B65D 85/62

[52] U.S. Cl. ..... 206/333; 206/461; 206/470; 206/467; 220/4.21

[58] Field of Search ..... 206/45.31, 45.34, 461, 206/463, 467, 470, 471, 333, 806; 220/4 B; D 9/415

[56] References Cited

U.S. PATENT DOCUMENTS

| | | | |
|---|---|---|---|
| D. 185,890 | 8/1959 | Barton | 206/471 |
| D. 267,394 | 12/1982 | Liptak et al. | D9/415 |
| D. 294,123 | 2/1988 | Hill | D9/415 |
| D. 305,733 | 1/1990 | Ferris | D9/415 |
| 2,937,746 | 5/1960 | Ferguson | 206/463 |
| 3,424,306 | 1/1969 | Munck | 206/333 |
| 3,776,375 | 12/1973 | Rohdin | 206/463 |
| 3,856,137 | 12/1974 | Brindley | 206/462 |
| 3,881,601 | 5/1975 | Walus et al. | 206/471 |
| 3,937,389 | 2/1976 | Wind | 220/4 B |
| 4,427,705 | 1/1984 | Wyslotsky et al. | 206/461 |
| 4,512,474 | 4/1985 | Harding | 206/470 |
| 4,687,129 | 8/1987 | Cugley | 206/470 |
| 4,896,770 | 1/1990 | Calcerano et al. | 206/333 |

FOREIGN PATENT DOCUMENTS

| | | | |
|---|---|---|---|
| 2557540 | 6/1977 | Fed. Rep. of Germany | 206/461 |
| 3219303 | 2/1983 | Fed. Rep. of Germany | 206/806 |
| 6703294 | 9/1967 | Norway | 206/461 |
| 2029360 | 3/1980 | United Kingdom | 206/470 |

OTHER PUBLICATIONS

Packaging Engineer, Aug. 1986, vol. 31, No. 9, p. 53, "Clamshell", Blisters.

*Primary Examiner*—David T. Fidei
*Attorney, Agent, or Firm*—Leonard Bloom

[57] ABSTRACT

A blister package for the display of four batteries. The package includes a housing formed by a front blister, a rear blister and a diagonal seam formed therebetween for removably joining the blisters to one another. The seam is offset towards the front blister, such that the rear blister is larger than the front. Two lower batteries are substantially horizontally disposed in the housing in a side-by-side arrangement. Two upper batteries are also substantially horizontally disposed in the housing in a side-by-side arrangement on top of the lower batteries. A header is pivotably joined to the housing being offset rearwardly thereon. In this fashion, when supported by the header the front blister hangs downwardly, thereby displaying at least three of the batteries or the package may be self-supporting.

24 Claims, 5 Drawing Sheets

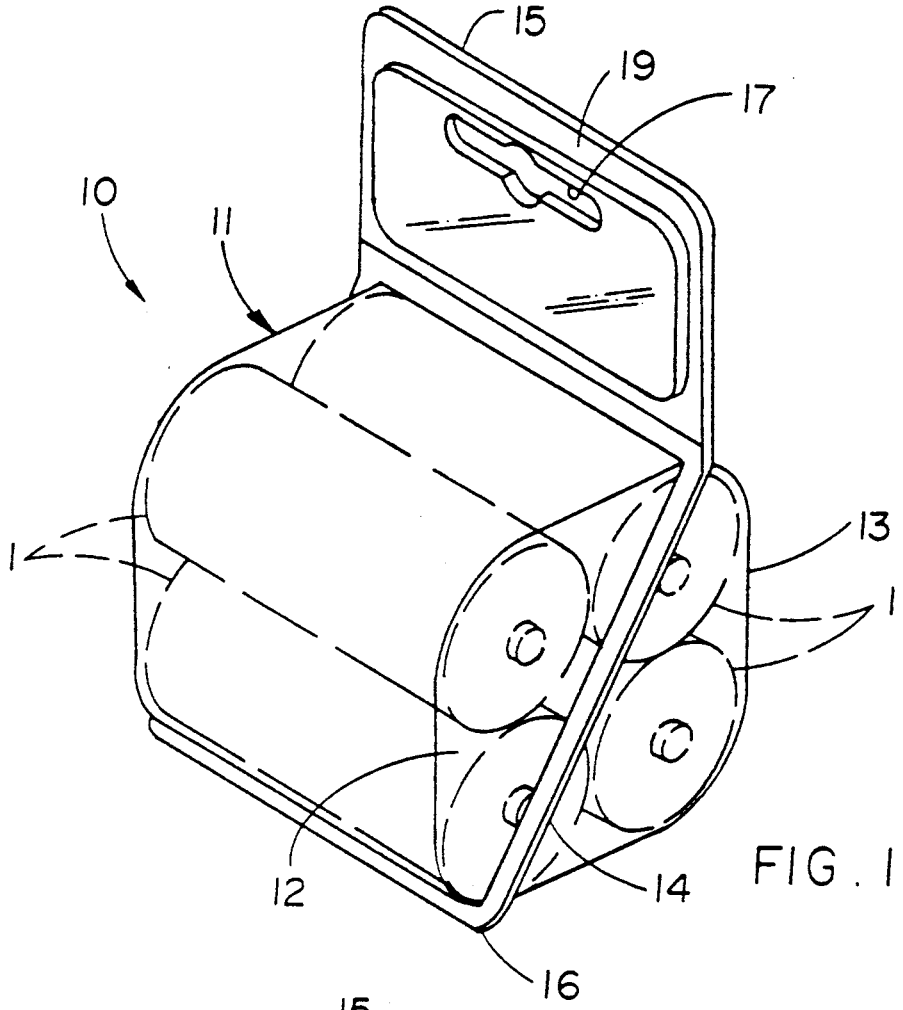
FIG. 1
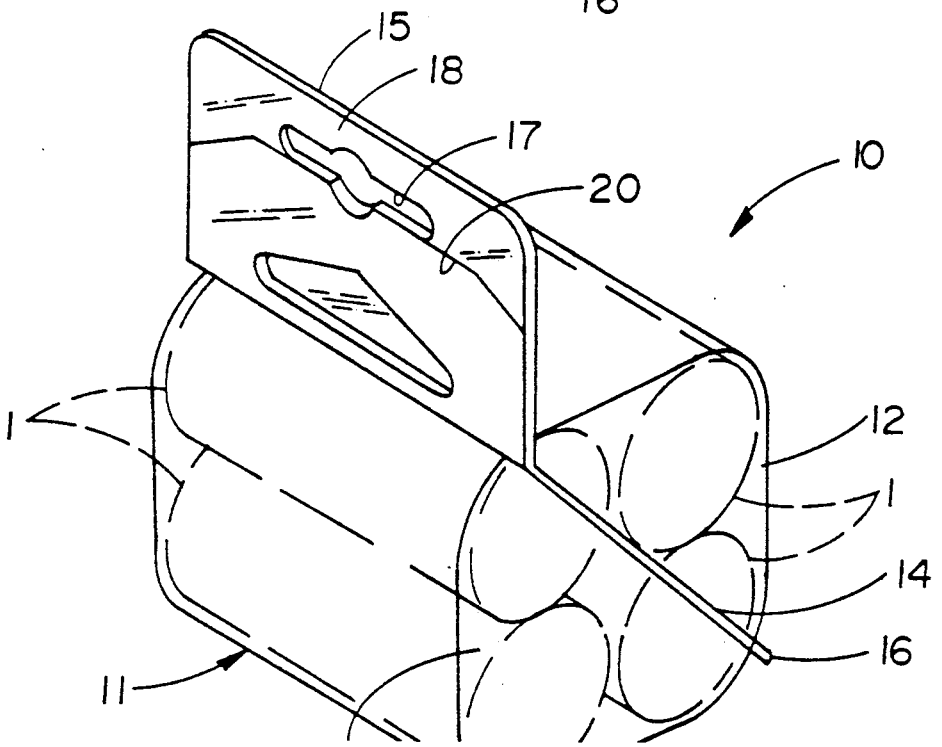

BATTERY DISPLAY PACKAGE

FIELD OF THE INVENTION

The present invention relates to packages for the shipment and display of items and, in particular, to blister packages for the display and shipment of batteries.

BACKGROUND OF THE INVENTION

For the most part, common battery packages were originally designed for two batteries at a time. However, portable electronic devices that require the use of more than two batteries have become increasingly popular. Thus, it has become necessary to provide packages that hold at least four batteries therein.

Unfortunately, packages that hold four (or more) batteries therein face particular problems.

First, the size of such packages has often proven difficult. Most existing display racks (for hanging) and shelves are sized for the lateral width of conventional two-battery packages and do not possess a lateral width that is large enough for four cells to be vertically disposed side-by-side in a "four-across" arrangement. This is due to the fact that the lateral width of the conventional two-cell package is about four inches, less than the combined lateral width of four "C" or "D" cells that are vertically positioned in a side-by-side arrangement. To use larger packages would require replacement or enlargement of present display racks and shelves.

Second, it is preferred that the cells be displayed in clear packaging, so that the batteries are visible to potential purchasers. In this regard, it is further desired that potential purchasers be able to view more than just two of the cells in the package. In this manner, potential purchasers will not incorrectly believe that the marked price for the four cells is the price for only two cells.

Third, when hanging (rack) space is not available, the battery packages must be free-standing and self-supporting for being placed on a shelf. In order to increase the amount of packages displayed, it is often desired to stack the packages. The necessity to be stackable is even more acute. When the package is large, such as when four-battery packages are involved. Lack of such stackability may even prevent such packages from being stocked and/or displayed.

Fourth, it is essential that such large packages be complementary shaped to permit multiple alignment, so that one package is immediately adjacent to the next package without wasting space. Thus, the amount of space needed therefor is reduced as much as possible for aiding in the storage and shipment thereof.

There have been several packages of which I am aware that attempt to address the above-mentioned problems.

In U.S. Pat. No. 4,896,770 issued to Calcerano et al, a battery package is disclosed that attempts to solve the problems associated with lateral width and the ability to view at least three of the cells packaged therein. The batteries are vertically oriented with three of the batteries in a staggered side-by-side arrangement, wherein one of the three batteries is positioned between and partially forwardly of the other two cells. The fourth cell is positioned between and partially behind the other two cells mentioned above, being directly behind the one of the three batteries.

While presenting a reduced lateral width than the "four-across" arrangement simultaneously with permitting three of the batteries to be viewed, such a package nonetheless still possesses a lateral width that is undesirably large.

Also, the package disclosed in Calcerano et al, is provided with blisters that have surfaces which are specifically contoured to conform to the shape and size of the particular cells to be held therein.

Further, it is noted that packages having such irregular shapes are not complementary shaped and do not permit the multiple alignment thereof that would permit one package to be immediately adjacent to one another. Rather, space is wasted therebetween. This increases the amount of space needed for the shipment, storage and display of such packages.

Finally, it is noted that the package is also equipped with a header (to permit the hanging thereof on, i.e., a display rack) that prevents the satisfactory stacking thereof during shipment, storage or display. Thus, further problems with space availability are presented.

I am also aware of another package presently being marketed that is substantially the same as that of Calcerano et al, but which does not present or possess contoured edges. That package, in having the batteries disposed in the same vertical staggered arrangement as Calcerano et al, likewise possess a lateral width that is undesirably large. Also, this package is also equipped with a header that limits the stacking thereof during shipment, storage and display, thus presenting further problems with space availability.

Another package of which I am aware involves a strip package wherein four batteries are horizontally oriented in a "four-down" arrangement in which each battery is spaced from the next and further in which a blank sheet or space is formed between the second and third batteries. Further, various "bubbles" are formed along the vertical height of the strip to aid in permitting the strip package to be folded into a quadrilateral shape for use as a free-standing display. Unfortunately, the vertical height of this strip package is, when unfolded, over twice as great as conventional packages and even when folded, is still vertically taller than the conventional packages. This presents problems of storing and displaying such packages on display racks where available vertical height is often limited.

Thus, it can be seen that there remains a need for a package for the display of at least four batteries wherein the lateral width of the batteries disposed therein in the same as that of the conventional two battery packages, while displaying at least three of the batteries for view by potential purchasers and which package may be easily stacked for the shipment, storage and/or display thereof.

SUMMARY OF THE INVENTION

It is a primary object of the present invention to provide a package for the display of batteries wherein four batteries are disposed in an arrangement wherein the lateral width of the batteries is the same as that of conventional two battery packages, while still permitting at least three of said batteries to be viewed while on display by potential purchasers.

It is a further primary object of the present invention to provide such a four-battery display package that possesses a header for the display thereof on a rack, which header nonetheless does not prevent the stacking of such packages for the shipment, storage and/or display thereof.

A further primary object of the present invention is to provide such a package to be complementary-shaped to permit multiple alignment, so that one package is immediately adjacent to the next package, so that the packages may be easily and satisfactorily positioned and displayed on a shelf while minimizing lost or wasted space and maximizing the use of the space available.

In accordance with the teachings of the present invention, a package is disclosed for the display of batteries. This package includes a housing formed by a first blister and a second blister. The housing has a substantially diagonal seam formed therebetween for removably joining the first and second blisters to one another. Preferably, the seam is offset towards the first blister, such that the second blister is larger than the first blister. The housing is sized to receive therein at least two lower batteries disposed substantially horizontally therein in a side-by-side arrangement on top of the lower batteries.

Preferably, a header is joined to the housing being offset rearwardly thereon. In this manner, when supported by the header on, for example, a display rack, the first blister of the housing hangs downwardly. In this fashion, at least three of the batteries is displayed when the package is viewed.

It is further preferred that the housing be substantially quadrilateral (rhomboid) in shape, so that the housing is complementary-shaped. In this manner, multiple alignment of such packages with other such packages is permitted. This permits the packages to be immediately adjacent to the next package without wasting space therebetween.

These and other objects of the present invention will become apparent from the following specification, when taken in conjunction with the enclosed figures.

BRIEF DESCRIPTION OF THE DRAWINGS

FIG. 1 is a front perspective view of the package of the present invention.

FIG. 2 is a rear perspective view of the package of the present invention.

DESCRIPTION OF PREFERRED EMBODIMENTS

Figure 3:
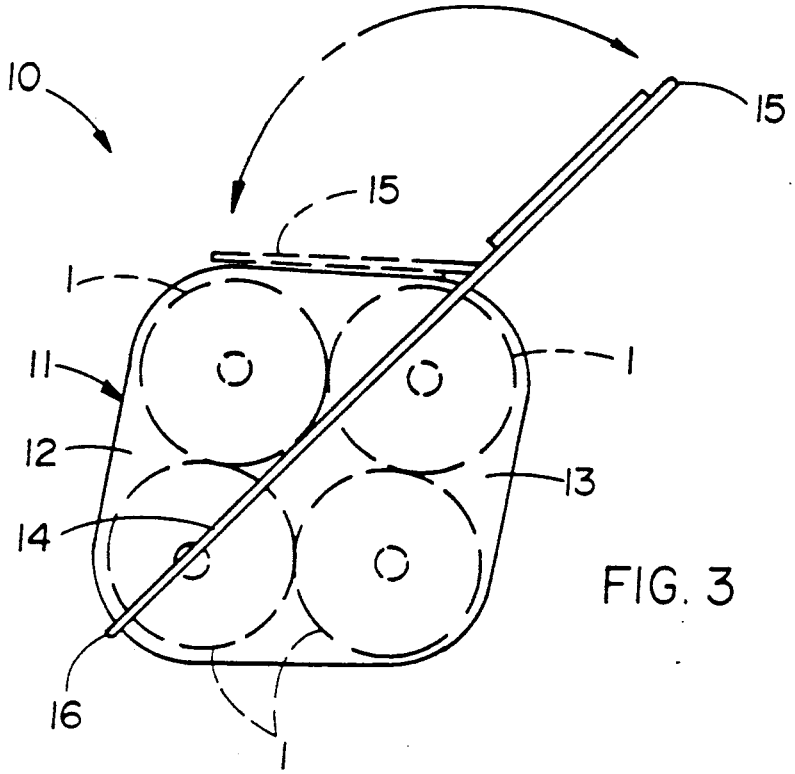
FIG. 3 is a side view of the package showing, in phantom lines, the alternative positioning of the header and the pivoting of the header when provided with a living hinge.

Referring now to the drawings, and in particular, to FIGS. 1–3, the package 10 is a blister package for displaying four batteries 1 therein. The package 10 includes a housing 11 formed by a front (first) blister 12 and a rear (second) blister 13. The front and rear blisters 12 and 13, respectively are removably joined to one another along a substantially diagonal seam 14. Also joined to the housing 11 is a header 15 that extends substantially upwardly therefrom.

The various components 12, 13 and 15 of the package 10 are fabricated from a transparent, heavy gauge, thermoplastic material. An example of such is cold crack resistant polyvinyl chloride. Preferably, the thermoplastic sheets are about 0.014 inches thick.

The housing 11 of the package 10 is sized to receive therein a pair (at least two) of lower batteries that are disposed substantially horizontally therein in a side-by-side arrangement. In this respect, one of the two lower batteries (the lower forward battery) is positioned forwardly in front of the other of the two lower batteries (the lower rearward battery). The housing 11 is further sized to receive therein a pair (at least two) of upper batteries that are also disposed substantially horizontally therein in a side-by-side arrangement on top of the lower batteries. In this respect, one of the two upper batteries (the upper rearward battery) is positioned rearwardly behind the other of the two upper batteries (the upper forward battery).

Each of the batteries 1 mentioned above has a midpoint that is coincident with the terminal of the respective battery. It is noted that the lateral width of the package 10 when the batteries are horizontally disposed or oriented is less than the lateral width of a package when three batteries are vertically disposed or oriented. Generally the overall lateral width of the package 10 is reduced so that four packages fit in the space that three packages of the prior art would occupy.

Preferably, the seam 14 is not centered but is offset towards the front blister 12, such that the rear blister 13 is larger than the front blister 12. In this respect, it is especially preferred that the diagonal seam 14 extends from the upper rear of the package 10 to the lower front and intersects the one of the two upper batteries (the upper rearward battery) forwardly of the midpoint thereof, and further that the diagonal seam 14 intersects the one of the two lower batteries (the lower forward battery) at the midpoint thereof. Furthermore, this offset seam 14 provides a rear blister 13 that can hold all of the batteries 1 therein, so that during manufacture the batteries 1 are stacked in the rear blister 13 while it is horizontal. The front blister 12 may then be placed over the rear blister 13 and the batteries 1 therein and be welded (by, for example, radio frequency welding, ultrasonic welding or heat sealing) thereto along the said seam 14.

Figure 4:
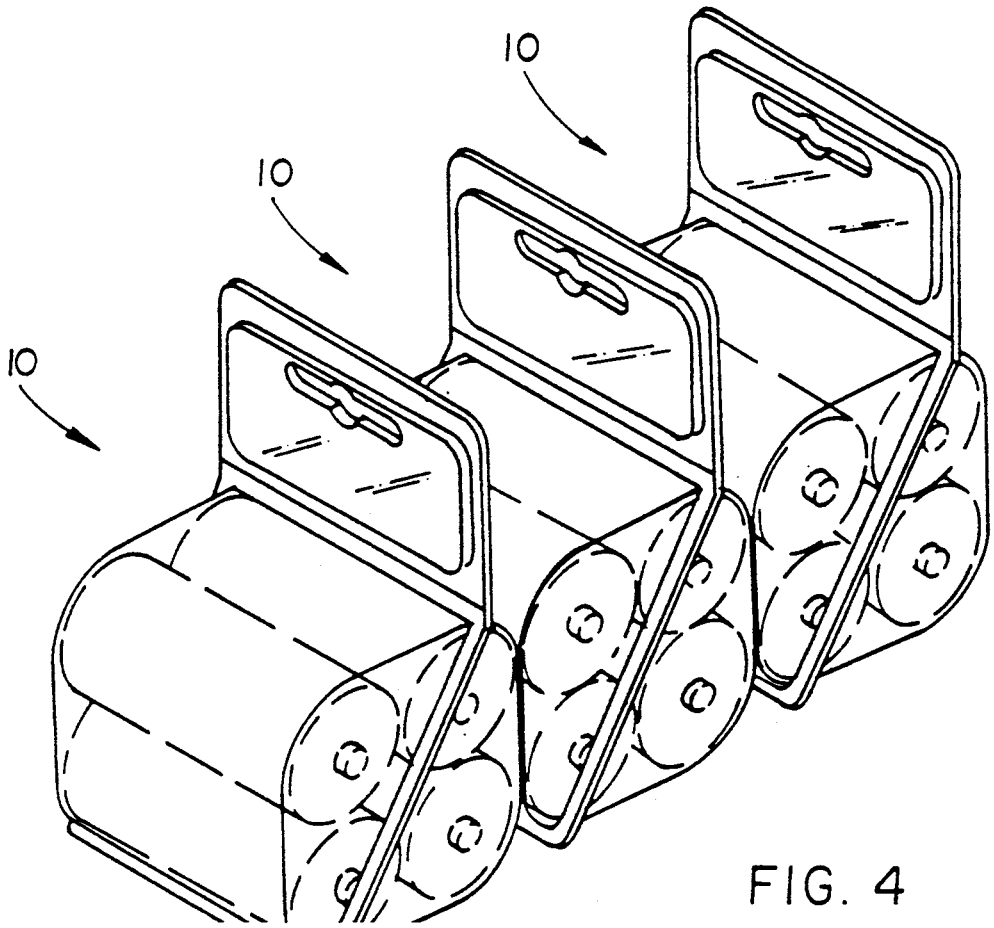
FIG. 4 illustrates the disposal of the packages on a shelf for the display thereof in multiple alignment, so that one package is immediately adjacent to the next package without wasting any space therebetween.
Figure 5:
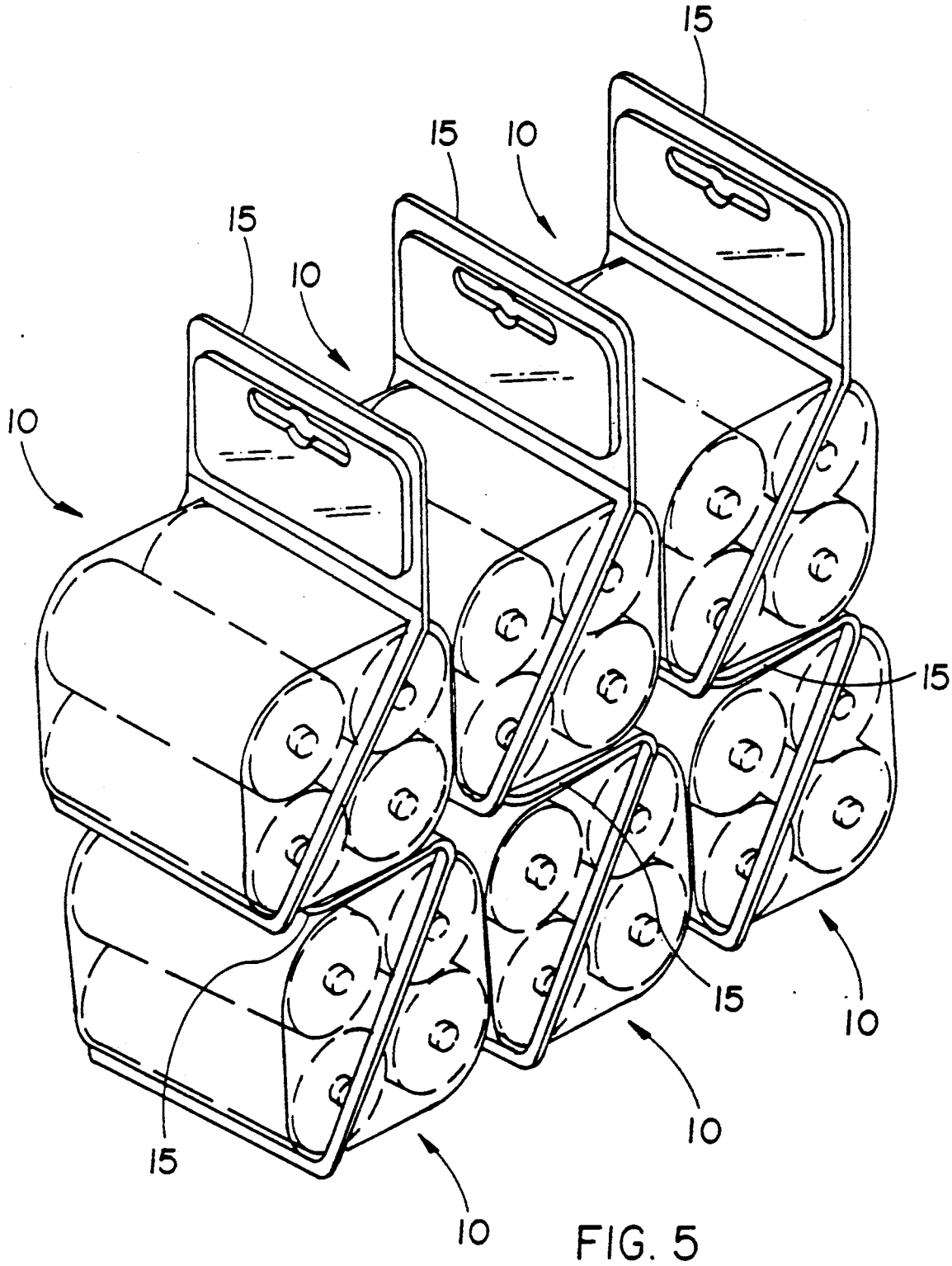
FIG. 5 corresponds substantially to FIG. 4 and further shows how the packages are stacked on one another during the storage or display thereof.

It is noted that, preferably, the housing 11 is substantially quadrilateral (rhomboid, rectangular or square) in shape having an upper rear and upper front as well as a lower rear and a lower front. In this fashion, the housings 11 are complementary-shaped permitting the multiple alignment thereof with other such packages. This permits each of the packages 10 to be positioned immediately adjacent to the next package without wasting space therebetween (see, in particular, FIGS. 4–5 and 8).

Figure 8:
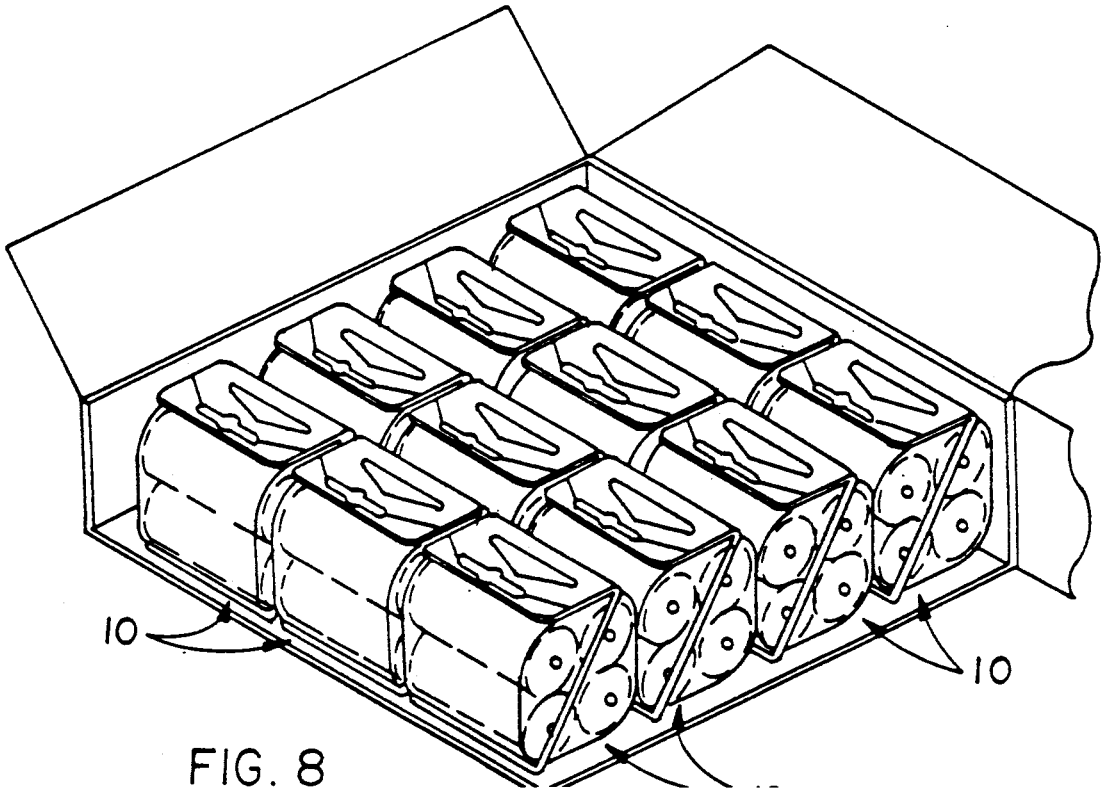
FIG. 8 shows how the packages are disposed in a carton with the headers bent over the respective housings of the various packages for the shipment thereof.

If desired, the seam 14 may be formed so as to include an edge 16 that extends substantially downwardly from the blisters 12 and 13. In this fashion, a foot 16 is defined thereby. This foot 16 aids in supporting the package 10 level on a flat surface such as a shelf or counter (FIGS. 4–5) or in a box (FIG. 8).

Figure 6A:
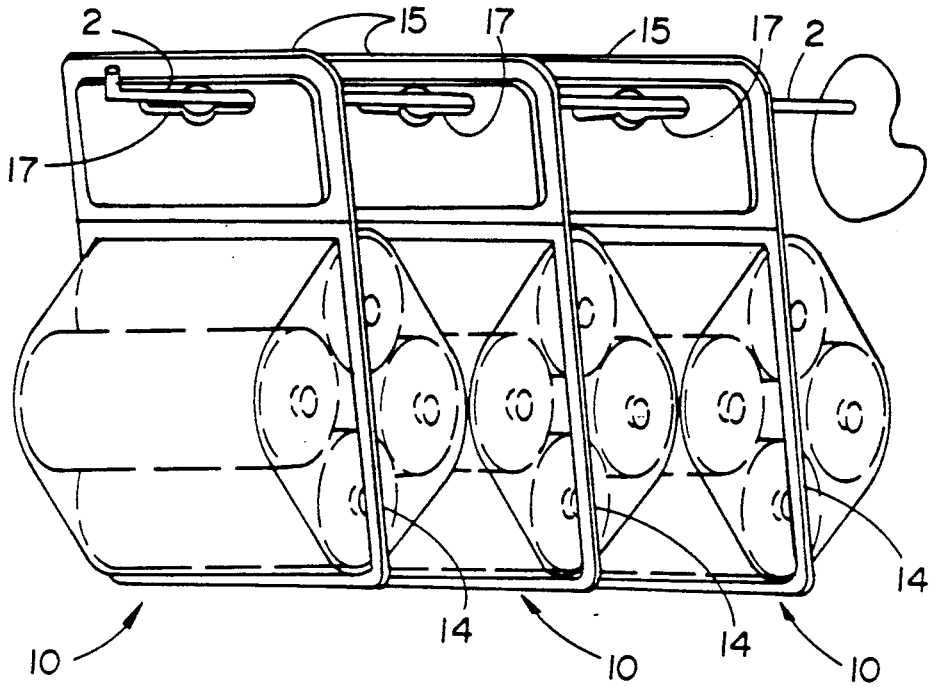
FIGS. 6A–6B illustrate the disposal of the packages on a rack for the display thereof by being hung by the header.
Figure 6B:
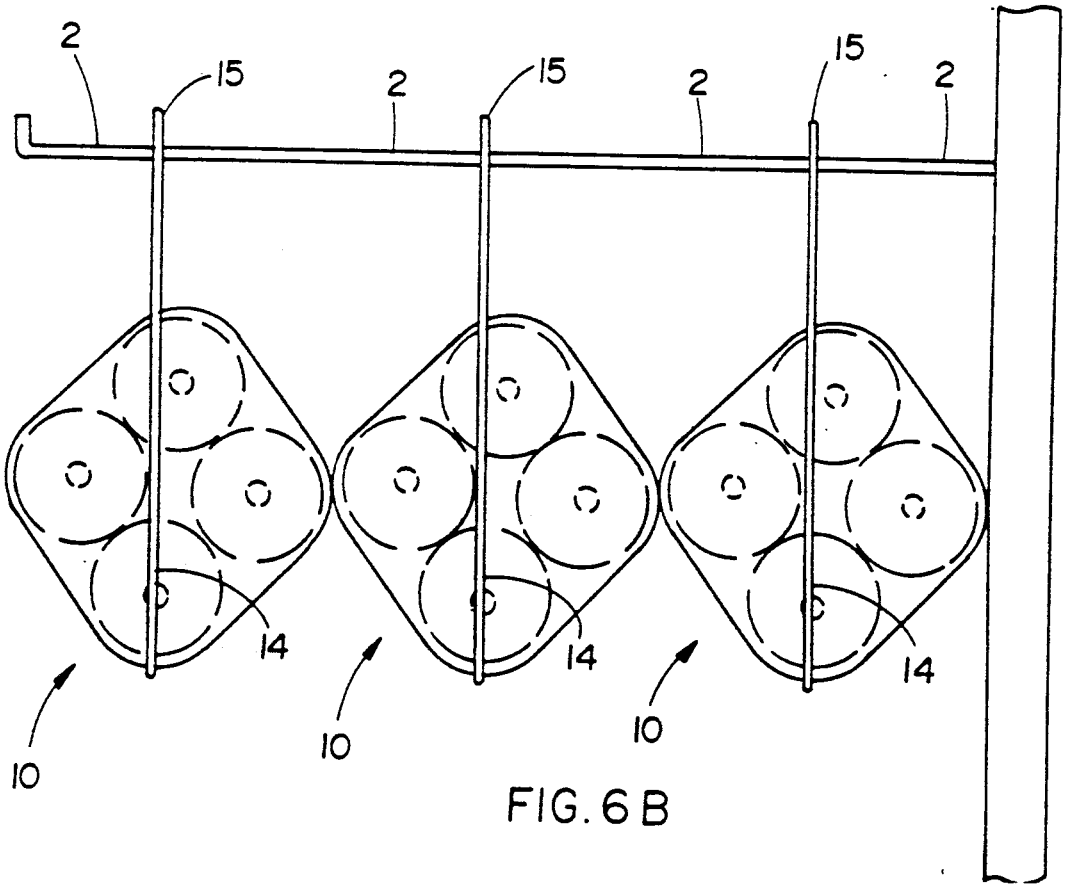

Preferably, the header 15 is joined to the housing 11 at the seam 14 thereof on the top of the housing 11 being offset rearwardly on the housing 11. In this fashion, when supported by the header 15, the front blister 12 of the housing 11 hangs downwardly, thereby displaying at least three of the batteries 1 when the package is viewed from the front (FIGS. 6A–6B).

It is further desired that the header 15 be jointed to the seam 14 by a living hinge 17. This hinge 17 permits the header 15 to be resiliently pivoted relative to the seam 14 (or the housing 11) for being folded (forwardly) over the package 10 during the stacking and shipping thereof (see FIGS. 3, 5 and 8). In this regard, it is noted that, when the header 15 is folded over the package, the package occupies very little space. This permits the package 10 of the present invention to be placed in a box 3 of four rows three in a row to reduce shipping and storage space. This further permits the packages 10 to be shipped without having a shipping tray.

The header 15 has an aperture rack stand hole or cut out 17 formed therein for removably receiving a support 2, such as a display rack, therethrough. In this fashion, the package 10 may be hung from the support 2 for the display thereof (see FIG. 6).

Figure 7:
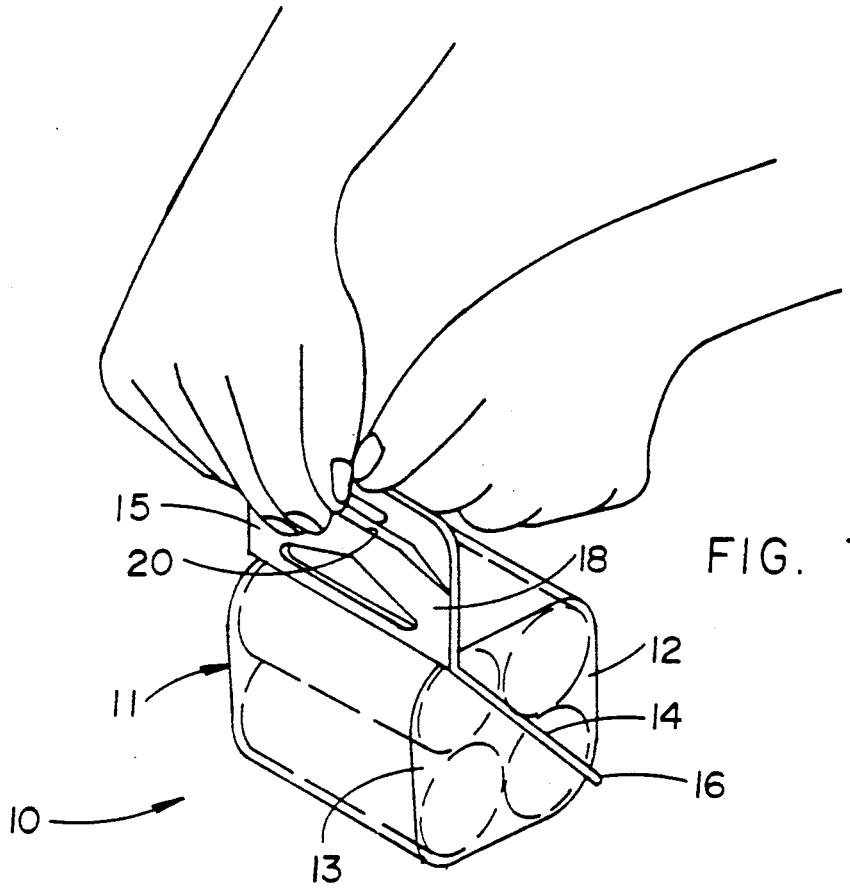
FIG. 7 is a rear view of the package showing the two-layer construction of the header and how the user thereof separates the two layers of the header for opening the package.

With particular reference now to FIG. 7, the header 15 is formed from a back layer 18 and a front layer 19. The back layer 18 is joined to the rear blister 13 and the front layer 19 is joined to the front blister 12. The two (front and back) layers 18 and 19 are removably joined to one another by appropriate means (such as radio frequency welding etc.).

A slit 20 is formed (die cut) in the back layer 18. Preferably, this slit 20 is located at the base of hole 17. This permits the user to insert a finger into the slit 20 and grasp one of the layers (the back layer 18) of the package. The two layers 18 and 19 can then be peeled apart along with the respective blisters 12 or 13 joined thereto for gaining access to the batteries 1 carried therein.

If desired a sheet with printing thereon may be inserted between the two layers 18 and 19 of the header 15. Alternatively, printing may be directly made on either or both of the layers 18 or 19. In this respect it is also noted that the clear nature of the housing permits insignia, information, etc., that is printed on the batteries themselves to be viewed by potential purchasers.

From the foregoing description, it can be seen that the package 10 of the present invention is designed to be, alternatively, hung from a rack or to self-standing (free-standing or self-supporting) for placement on a shelf or counter. The design permits multiple alignment, so that one package 10 is immediately adjacent to the next package without wasting space.

It can also be seen that the package, with its printed header 15 and its clear housing 10 is also a self-display. This greatly enhances its commercial value.

Finally, it is noted that the package 10 of the present invention can be used with any round battery such as "C", "D", "AA" and "AAA" size cells.

Obviously, many modifications may be made without departing form the basic spirit of the present invention. Accordingly, it will be appreciated by those skilled in the art, that within the scope of the appended claims, the invention may be practiced other than has been specifically described herein.

What is claimed is:

1. A package for the display of batteries comprising a substantially quadrilateral housing formed by a front blister and a rear blister, each blister having a substantially triangular cross-section, each blister having flanges extending outwardly therefrom, the flanges on the front blister being peripherally bonded to the flanges on the rear blister, forming a substantially diagonal seam therebetween for removably joining the front and rear blisters to one another, the seam being offset towards the front blister, such that the rear blister is larger than the front blister, the housing sized to receive therein at least two lower batteries disposed substantially horizontally therein in a side-by-side arrangement and at least two upper batteries disposed substantially horizontally therein in a side-by-side arrangement on top of the lower batteries, and the diagonal seam extending outwardly from the package forming a header joined to the housing and being offset rearwardly on the housing, such that when supported by the header, the front blister of the housing hangs downwardly, thereby displaying the batteries when the package is viewed from the front, and further such that the package is self-supporting for display on a surface.

2. The package of claim 1, wherein the header is joined to the housing by a living hinge, such that the header may be resiliently pivoted relative to the housing for being folded over the package during the stacking and shipping thereof.

3. The package of claim 1, further comprising the seam including an edge extending substantially downwardly from the blisters, thereby defining a foot for aiding in supporting the package level on a flat surface.

4. The package of claim 1, wherein the header further has an aperture formed therein for receiving a support therethrough, such that the package may be hung from the support for the display thereof.

5. The package of claim 1, wherein the header is joined to the housing at the seam thereof.

6. The package of claim 5, wherein the header is joined to the seam by a living hinge, such that the header may be resiliently pivoted relative to the seam for being folded over the package during the stacking and shipping thereof.

7. The package of claim 5, wherein the header is formed from a back layer that is joined to the rear blister and a front layer joined to the front blister, the two layers of the header being removably joined to one another having a slit formed therebetween, so that a user may break the bond between the flanges on the front blister and the flanges on the rear blister by inserting a finger into the slit and grasping one of the layers of the package for peeling the front layer of the header and the front blister from the rear layer of the header and the rear blister and opening the package.

8. The package of claim 1, wherein the housing is substantially quadrilateral in shape having an upper rear and a lower front, so that the housing is complementary-shaped permitting multiple alignment thereof with other of said packages, whereby the packages are immediately adjacent to the next package without wasting space therebetween.

9. The package of claim 8, further wherein the substantially diagonal seam is formed extending from the upper rear of the package to the lower front of the package.

10. The package of claim 9, wherein the header is joined to the seam at the upper rear of the package.

11. The package of claim 9, wherein the header is joined to the seam by a living hinge, such that the header may be resiliently pivoted relative to the seam for being folded forwardly over the package during the stacking and shipping thereof.

12. The package of claim 1, wherein each of the batteries has an end including a midpoint thereon, wherein when the housing is viewed from a side, the ends of the batteries are displayed, wherein the diagonal seam intersects one of the two upper batteries forwardly of the midpoint thereof, and further wherein the diagonal seam intersects one of the two lower batteries at the midpoint thereof.

13. A package for the display of batteries comprising a substantially quadrilateral housing formed by a first blister and a second blister each blister having a substantially-triangular cross-section, each blister having flanges extending outwardly therefrom, the flanges on the first blister being peripherally bonded to the flanges on the second blister, forming a substantially diagonal seam therebetween for removably joining the front and rear blister to one another, the seam being offset towards the first blister, such that the second blister is larger than the first blister, the housing sized to receive therein at least two lower batteries disposed substantially horizontally therein in a side-by-side arrangement and at least two upper batteries disposed substantially horizontally therein in a side-by-side arrangement on top of the lower batteries, and the diagonal seam extending outwardly from the package forming a header joined to the housing and being offset rearwardly on the housing, such that when supported by the header, the first blister of the housing hangs downwardly, thereby displaying the batteries when the package is viewed from the front, and further such that the package is self-supporting for display on a surface.

14. A package for the display of batteries comprising a substantially quadrilateral housing formed by a front blister and a rear blister, each blister having a substantially triangular cross-section, each blister having flanges extending outwardly therefrom, the flanges on the front blister being sealed to the flanges on the rear blister, forming a substantially diagonal seam therebetween for removably joining the front and rear blisters to one another, the seam being offset towards the front blister, such that the rear blister is larger than the front blister, the housing sized to receive therein at least two lower batteries disposed substantially horizontally therein in a side-by-side arrangement and at least two upper batteries disposed substantially horizontally therein in a side-by-side arrangement on top of the lower batteries, the diagonal seam extending outwardly from the package forming a header joined to the seam of the housing by a living hinge and being offset rearwardly on the housing, such that when supported by the header, the front blister of the housing hangs downwardly, thereby displaying the batteries when the package is viewed from the front, and further such that the header may be resiliently pivoted relative to the housing for being folded over the package during the stacking and shipping thereof, and still further such that the package is self-supporting for display on a surface.

15. A package for the display of batteries comprising a substantially quadrilateral housing formed by a front blister and a rear blister, each blister having a substantially triangular cross-section, each blister having flanges extending outwardly therefrom, the flanges on the front blister being peripherally bonded to the flanges on the rear blister, forming a substantially diagonal seam therebetween for removably joining the front and rear blisters to one another, the seam being offset towards the front blister, such that the rear blister is larger than the front blister, the housing sized to receive therein at least two lower batteries disposed substantially horizontally therein in a side-by-side arrangement and at least two upper batteries disposed substantially horizontally therein in a side-by-side arrangement on top of the lower batteries, and a header joined to the seam of the housing by a living hinge and being offset rearwardly on the housing, such that when supported by the header, the front blister of the housing hangs downwardly, thereby displaying the batteries when the package is viewed from the front, and further such that, the header may be resiliently pivoted relative to the seam for being folded over the package during the stacking and shipping thereof, that the package further being self-supporting for display on a surface, and wherein the header is formed from the back layer that is joined to the rear blister and a front layer joined to the front blister, the two layers of the header being removably joined to one another having a slit formed therebetween, so that a user may break the bond between the flanges on the front blister and the flanges on the rear blister by inserting a finger into the slit and grasping one of the layers of the package for peeling the front layer of the header and the front blister from the rear layer of the header and the rear blister and opening the package.

16. A package for the display of batteries comprising a substantially quadrilateral housing having an upper rear and a lower front, so that the housing is complementary-shaped permitting multiple alignment thereof with other of said packages, whereby the packages are immediately adjacent to the next package without wasting space therebetween, the housing being formed by a front blister and a rear blister, each blister having a substantially triangular cross-section, each blister having flanges extending outwardly therefrom, the flanges on the front blister being peripherally bonded to the flanges on the rear blister, forming a substantially diagonal seam therebetween for removably joining the front and rear blisters to one another, the seam being offset towards the front blister, such that the rear blister is larger than the front blister, the housing sized to receive therein at least two lower batteries disposed substantially horizontally therein in a side-by-side arrangement and at least two upper batteries disposed substantially horizontally therein in a side-by-side arrangement on top of the lower batteries, and a header joined to the seam of the housing and being offset rearwardly on the housing, such that when supported by the header, the front blister of the housing hangs downwardly, thereby displaying at least three of the batteries when the package is viewed form the front, and further such that the package is self-supporting for display on a surface, wherein the header is joined to the seam by a living hinge, such that the header may be resiliently pivoted relative to the seam for being folded over the package during the stacking and shipping thereof, wherein the header is formed from a back layer that is joined to the rear blister and a front layer joined to the front blister, the two layers of the header being removably joined to one another having a slit formed therebetween, so that a user may break the bond between the flanges on the front blister and the flanges on the rear blister by inserting a finger into the slit and grasping one of the layers of the package for peeling the front layer of the header and the front blister from the rear layer of the header and the rear blister and opening the package.

17. A package for the display of batteries comprising a substantially quadrilateral housing having an upper rear and a lower front, so that the housing is complementary-shaped permitting multiple alignment thereof with other of said packages, whereby the packages are immediately adjacent to the next package without wasting space therebetween, the housing being formed by a front blister and a rear blister, each blister having a substantially triangular cross-section, each blister having flanges extending outwardly therefrom, the flanges on the front blister being peripherally bonded to the flanges on the rear blister, forming a substantially diagonal seam therebetween extending from the upper rear of the package to the lower front of the package for removably joining the front and rear blisters to one another, the seam being offset towards the front blister, such that the rear blister is larger than the front blister, the housing sized to receive therein at least two lower batteries disposed substantially horizontally therein in a side-by-side arrangement and at least two upper batteries disposed substantially horizontally therein in a side-by-side arrangement on top of the lower batteries, and a header joined to the seam of the housing and being offset rearwardly on the housing, such that when supported by the header, the front blister of the housing hangs downwardly, thereby displaying at least three of the batteries when the package is viewed from the front, and further such that the package is self-supporting for display on a surface, wherein the header is joined to the seam at the upper rear of the package by a living hinge, such that the header may be resiliently pivoted relative to the seam for being folded over the package during the stacking and shipping thereof, wherein the header is formed from a back layer that is joined to the rear blister and a front layer joined to the front blister, the two layers of the header being removably joined to one another having a slit formed therebetween, so that a user may break the bond between the flanges on the front blister and the flanges on the rear blister by inserting a finger into the slit and grasping one of the layers of the package for peeling the front layers of the header and the front blister from the rear layer of the header and the rear blister and opening the package.

18. A blister package for the display of batteries comprising a first blister and a second blister, each blister having a substantially triangular cross-section, each blister having flanges extending outwardly therefrom, the flanges on the first blister being peripherally bonded to the flanges on the second blister forming a substantially diagonal seam therebetween for removably joining the first and second blisters to one another, the diagonal seam extending outwardly from the package forming a header joined to the housing and being offset rearwardly on the housing such that the package may be supported by the header, the housing being sized to receive therein at least two lower batteries disposed substantially horizontally therein in a side-by-side arrangement, and at least two upper batteries disposed substantially horizontally therein in a side-by-side arrangement on top of the lower batteries, the housing being substantially quadrilateral in shape, so that the housing is complementary-shaped permitting the multiple alignment thereof with other such packages, whereby the packages are immediately adjacent to the next package without wasting space therebetween and the package is self-supporting for display on a surface.

19. A package for the display of batteries comprising a substantially quadrilateral housing formed by a front blister and a rear blister, each blister having a substantially triangular cross-section, each blister having flanges extending outwardly therefrom, the flanges on the front blister being peripherally bonded to the flanges on the rear blister, forming a substantially diagonal seam therebetween for removably joining the front and rear blisters to one another, the housing sized to receive therein at least two lower batteries disposed substantially horizontally therein in a side-by-side arrangement and at least two upper batteries disposed substantially horizontally therein in a side-by-side arrangement on top of the lower batteries, the diagonal seam extending outwardly from the package forming a header joined to the housing and being offset rearwardly on the housing, such that when supported by the header, the front blister of the housing hangs downwardly, thereby displaying the batteries when the package is viewed from the front, and further such that the package is self-supporting for display on a surface.

20. A blister package for the display of batteries comprising a substantially quadrilateral housing formed by a first blister and a second blister, each blister having a substantially triangular cross-section, each blister having flanges extending outwardly therefrom, the flanges on the front blister being bonded to the flanges on the rear blister, forming a substantially diagonal seam therebetween for removably joining the first and second blisters to one another, the housing being sized to receive therein at least two lower batteries disposed substantially horizontally therein in a side-by-side arrangement, and at least two upper batteries disposed substantially horizontally therein in a side-by-side arrangement on top of the lower batteries, and the diagonal seam extending outwardly from the package forming a header joined to the housing and being offset rearwardly on the housing, such that when supported by the header, the front blister of the housing hangs downwardly, thereby displaying the batteries when the package is viewed from the front, and further such that the package is self-supporting for display on a surface.

21. A substantially quadrilateral sealed display package for a plurality of batteries, the batteries being substantially cylindrical and having a trademark affixed longitudinally thereon, wherein the package may be hung on a display rack or, at the option of the retail merchandiser, may be placed on a counter, and wherein the package size is minimized both in height and in lateral width, thereby maximizing the number of batteries that may be merchandised in a given space, the package comprising a substantially-flat rear blister including an outwardly-projecting rear pocket having a substantially triangular cross-section, the rear blister further having a first end, a second end and two sides therebetween, a flange extending outwardly from the first end and from the sides of the rear pocket, a first header extending outwardly from the second end of the rear pocket, the first header being larger than the flange on the first end; the package further comprising a substantially-flat front blister including an outwardly-projecting front pocket having a substantially triangular cross-section, the front pocket having a first end, a second end and two sides therebetween, a flange extending out wardly from the first end and from the sides of the front pocket, a second header extending outwardly from the second end of the front pocket, the second header being larger than the flange on the first end of the front pocket, the second header being substantially the same size as the first header, the front blister being complementary to the rear blister, each pocket having a measured lateral width from its sides which is slightly larger than the length of the batteries, such that when the front blister is disposed adjacent to the rear blister, the plurality of batteries may be disposed horizontally within the pockets with the trademark on the batteries being readily viewed by a prospective purchaser, the flanges and first header on the front blister being adjacent to the flanges and second header on the rear blister and peripherally bonded thereto, wherein a diagonal seam is formed between the front blister and the rear blister, the headers being an extension of the seam, the headers having an opening formed therein for hanging the package on a display rack, the package also being self supporting for display on a surface, and the package nesting with similar packages to facilitate stacking and storage.

22. The sealed display package of claim 21, wherein four batteries may be received in the package.

23. The sealed display package of claim 21, wherein the first header and the second header are removably joined to one another having a slit formed therebetween, so that a user may break the bond between the flanges on the front blister and the flanges on the rear blister by inserting a finger into the slit and grasping one of the headers of the package for peeling the front header and the front blister from the rear header and the rear blister and opening the package.

24. The sealed display package of claim 21, wherein the seam includes an edge extending substantially downwardly from the blisters, thereby defining a foot for aiding in supporting the package level on a flat surface.

* * * * *